US011932471B2

(12) United States Patent
Bailey et al.

(10) Patent No.: US 11,932,471 B2
(45) Date of Patent: Mar. 19, 2024

(54) DUAL CAVITY SLIDING DISPENSER

(71) Applicant: R. J. Reynolds Tobacco Co., Winston-Salem, NC (US)

(72) Inventors: Ryan Bailey, Raleigh, NC (US); John Anthony Gelardi, Midlothian, VA (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 164 days.

(21) Appl. No.: 17/242,881

(22) Filed: Apr. 28, 2021

(65) Prior Publication Data

US 2021/0245919 A1 Aug. 12, 2021

Related U.S. Application Data

(62) Division of application No. 14/974,739, filed on Dec. 18, 2015, now Pat. No. 11,021,293, which is a division of application No. 12/412,809, filed on Mar. 27, 2009, now Pat. No. 9,248,935.

(60) Provisional application No. 61/118,738, filed on Dec. 1, 2008.

(51) Int. Cl.
*B65D 6/06* (2006.01)
*B65D 83/04* (2006.01)

(52) U.S. Cl.
CPC ..... *B65D 7/10* (2013.01); *B65D 9/08* (2013.01); *B65D 11/12* (2013.01); *B65D 83/0409* (2013.01); *B65D 2215/02* (2013.01); *B65D 2215/04* (2013.01)

(58) Field of Classification Search
CPC ..... B65D 7/10; B65D 7/10331; B65D 9/08; B65D 11/12; B65D 83/0409; B65D 2215/02; B65D 2215/04
USPC ..... 221/301, 1.5, 1, 15; 206/459.1, 1.5, 528, 206/531, 538, 540
See application file for complete search history.

(56) References Cited

U.S. PATENT DOCUMENTS

| | | | |
|---|---|---|---|
| 194,197 | A | 8/1877 | Villaret |
| 533,044 | A | 1/1895 | Bingham |
| 889,568 | A | 6/1908 | Albrecht |
| 1,701,565 | A | 2/1929 | Hammett |
| 1,837,722 | A | 12/1931 | Mcatree |
| 2,090,530 | A | 8/1937 | Guffey et al. |
| 2,686,627 | A | 8/1954 | Mcelwee |

(Continued)

FOREIGN PATENT DOCUMENTS

| | | | |
|---|---|---|---|
| CH | 180218 | A | 10/1935 |
| CN | 2665032 | Y | 12/2004 |

(Continued)

*Primary Examiner* — Rakesh Kumar
(74) *Attorney, Agent, or Firm* — Womble Bond Dickinson (US) LLP; Chris Humphrey; John V. Forcier

(57) ABSTRACT

A dispensing container is provided, the container including an outer shell comprising a top, a bottom, sidewalls extending between the top and bottom, and two ends, at least one end being open; an inner tray, slidably received within the outer shell, comprising at least one storage compartment adapted for storage of a plurality of units of a product to be dispensed, and comprising at least one depressible detent, the detent comprising a raised surface that abuts the outer shell; wherein, in a closed configuration, the detent holds the inner tray within the outer shell, and wherein the at least one detent may be depressed by pressure to allow the inner tray to slide relative to the outer shell.

3 Claims, 9 Drawing Sheets

(56) References Cited

U.S. PATENT DOCUMENTS 2,769,565 A 11/1956 Sottile
2,892,537 A 6/1959 Schwartz
3,346,167 A 10/1967 Schmidt
3,439,797 A 4/1969 Cooper et al.
3,563,412 A 2/1971 James
3,696,917 A 10/1972 Levi
3,761,009 A 9/1973 Rosenburg, Jr.
3,782,584 A 1/1974 Swenson et al.
3,895,737 A 7/1975 Phillips
B536,923 I5 3/1976 Mayled
4,007,828 A 2/1977 Mayled
4,057,145 A 11/1977 Wray et al.
4,076,117 A 2/1978 Wisdom et al.
4,113,098 A * 9/1978 Howard ..... A61J 1/03 220/345.3
4,120,400 A 10/1978 Kotyuk
4,154,365 A 5/1979 Lorca
4,284,204 A * 8/1981 Carey, Jr. ..... B65D 5/38 220/8
4,364,488 A 12/1982 Anjou et al.
4,437,579 A 3/1984 Obland
4,561,544 A 12/1985 Reeve
4,572,376 A 2/1986 Wrennall
4,611,727 A 9/1986 Graff
4,705,165 A 11/1987 Thieke
4,741,435 A 5/1988 Clarke
4,939,860 A 7/1990 Ackeret
4,967,909 A 11/1990 McKibben
5,080,222 A 1/1992 McNary
5,082,137 A 1/1992 Weinstein
5,108,006 A 4/1992 Tieke et al.
5,174,471 A 12/1992 Kozlowski et al.
5,275,291 A * 1/1994 Sledge ..... B65D 83/04 220/348
5,608,940 A * 3/1997 Panyon, Jr. ..... A46B 11/001 221/199
5,657,901 A 8/1997 Farside
5,782,359 A 7/1998 Mcallister et al.
5,816,441 A 10/1998 Farside
5,897,025 A 4/1999 Flewitt et al.
5,909,822 A 6/1999 George et al.
5,915,560 A 6/1999 George et al.
6,050,449 A 4/2000 Kanj
6,068,126 A 5/2000 DeJonge
6,119,864 A 9/2000 Kessler et al.
6,131,765 A 10/2000 Barry et al.
6,155,454 A 12/2000 George et al.
6,267,265 B1 7/2001 Issa
6,341,710 B1 1/2002 Danielson et al.
6,382,460 B1 5/2002 Gonzalez
6,460,693 B1 10/2002 Harrold
6,527,138 B2 3/2003 Pawlo et al.
6,564,967 B1 5/2003 Stringfield et al.
6,641,031 B2 11/2003 Evans et al.
6,758,338 B2 7/2004 Lien
6,789,677 B2 9/2004 Maietta
6,863,175 B2 3/2005 Gelardi
6,913,149 B2 7/2005 Gelardi et al.
6,976,576 B2 12/2005 Intini
7,159,720 B2 1/2007 Pearson
7,216,776 B2 5/2007 Gelardi
7,287,666 B2 10/2007 De Laforcade
7,320,413 B2 1/2008 Fusi
7,533,785 B2 5/2009 Smith et al.
7,584,843 B2 9/2009 Kutsch et al.
7,658,287 B2 * 2/2010 Hession ..... B65D 83/0463 206/528
7,708,142 B2 5/2010 Ehrlund
7,740,132 B2 6/2010 Oono et al.
7,757,843 B2 7/2010 Katsis
7,854,325 B2 * 12/2010 Bentele ..... B65D 83/0463 220/345.3
8,297,436 B2 10/2012 Gattefosse et al.
9,938,042 B1 * 4/2018 Aryanpanah ..... B65D 11/20
2002/0056652 A1 5/2002 Kawamura et al.
2002/0175195 A1 11/2002 Cole
2003/0085262 A1 * 5/2003 Evans ..... B65D 77/02 206/532
2003/0102321 A1 * 6/2003 Maietta ..... B65D 83/0463 220/283
2003/0106900 A1 6/2003 Storz
2004/0045858 A1 * 3/2004 Harrold ..... B65D 83/0463 206/470
2004/0055903 A1 * 3/2004 Nishimura ..... A45C 11/14 206/1.5
2004/0074917 A1 4/2004 McHutchinson et al.
2004/0217024 A1 11/2004 Arnarp et al.
2005/0011773 A1 1/2005 Intini
2005/0173272 A1 8/2005 Lemmons
2005/0183981 A1 8/2005 Gelardi
2005/0205598 A1 9/2005 Gelardi et al.
2006/0006091 A1 1/2006 Maietta
2006/0060480 A1 3/2006 Budd
2006/0118589 A1 6/2006 Arnarp et al.
2006/0124658 A1 6/2006 Coe et al.
2006/0243611 A1 11/2006 Wu
2007/0045150 A1 * 3/2007 Huffer ..... B65D 83/0463 206/538
2007/0068960 A1 3/2007 Valentine et al.
2007/0163911 A1 7/2007 Gelardi
2007/0246382 A1 10/2007 He
2007/0246383 A1 * 10/2007 He ..... B65D 7/06 206/268
2007/0277299 A1 12/2007 Kroon
2008/0029110 A1 2/2008 Dube et al.
2008/0029116 A1 2/2008 Robinson et al.
2008/0142535 A1 6/2008 Adler et al.
2009/0152134 A1 * 6/2009 Katsis ..... B65D 5/38 206/96
2009/0184023 A1 * 7/2009 Brollier ..... B65D 83/0463 206/469
2009/0200332 A1 8/2009 Intini
2009/0223989 A1 9/2009 Gelardi
2010/0300923 A1 * 12/2010 Sack ..... B65D 83/0463 53/473
2011/0163155 A1 * 7/2011 Kalin ..... A61J 1/03 229/122

FOREIGN PATENT DOCUMENTS

CN 1968856 A 5/2007
GB 2042476 A 9/1980
GB 2374862 A * 10/2002 ..... B65D 25/04
JP 52-092967 U 7/1977
JP 59-190223 U 12/1984
JP 60-054420 U 4/1985
JP 62-146715 U 9/1987
JP 63-082722 U 5/1988
JP 2002-046784 A 2/2002
JP 2006-001617 A 1/2006
WO WO-1999048391 A 9/1999
WO WO-2004035404 A1 4/2004
WO WO-2004037657 A2 5/2004
WO WO-2005016036 A1 2/2005
WO WO-2005028316 A2 3/2005
WO WO-2005030606 A1 4/2005
WO WO-2005035390 A1 4/2005
WO WO-2005102849 A1 * 11/2005 ..... A24F 27/00
WO WO-2007017761 A2 2/2007
WO WO-2007067953 A2 6/2007
WO WO-2007070867 A2 6/2007
WO WO-2008070032 A2 6/2008
WO WO-2009055547 A1 4/2009
WO WO-2016132356 A1 * 8/2016 ..... A47B 87/0276

* cited by examiner

DUAL CAVITY SLIDING DISPENSER

CROSS-REFERENCE TO RELATED APPLICATIONS

This application is a divisional of U.S. pat. appl. Ser. No. 14/974,739, filed Dec. 18, 2015, which is a divisional of U.S. pat. appl. Ser. No. 12/412,809, filed Mar. 27, 2009, which claims priority to U.S. Provisional Pat. Appl. No. 61/118,738, filed Dec. 1, 2008, each of which is incorporated herein by reference in its entirety.

BACKGROUND OF THE INVENTION

Field of the Invention

The invention relates to containers and methods of use thereof. More particularly, the invention relates to containers that provide dispensing or dosing of the stored product.

Description of the Prior Art

Various types of containers for dispensing solid objects, particularly solid products intended for human consumption, are known in the art. Such containers are often characterized by a hand-held size that can be easily stored and transported. Exemplary consumable products that are often packaged in such containers include pharmaceutical compositions, oral tobacco products, snacks, mints, gums, breath strips, candy, and the like. One form of container is a formed metal "tin" comprising a bottom enclosure and a tightly fitting lid. Such a container may be expensive to make and may not provide sufficient resistance against a child opening the container.

Certain consumable products, such as pharmaceutical products, require containers having a certain level of child resistance. Traditionally, pills have been packaged in a bottle having a cap that can only be removed by applying downward pressure while twisting the cap. However, this type of child resistance has certain disadvantages. For example, if a child does manage to open the bottle, immediate access is provided to the entire contents of the bottle. Further, if an adult user fails to place the cap in the properly secured position, there is no secondary mechanism for preventing access by a child.

Exemplary containers that provide a locking mechanism for enhancing child-resistance of a container can be found, for example, in U.S. Pat. Nos. 6,863,175 to Gelardi; 6,913,149 to Gelardi et al.; 6,976,576 to Intini; and 7,216,776 to Gelardi, which are incorporated herein by reference in their entirety.

There remains a need in the art for a container for storing and dispensing a product that combines various advantageous features, such as child resistance, ease of manufacturing, and convenient size.

BRIEF SUMMARY OF THE INVENTION

The present invention provides a container that, in certain embodiments, combines child-resistance and a convenient handheld size. The type and form of the product to be stored and dispensed can vary, but film or sheet-like products are particularly well-suited for use with the containers of the invention.

In one aspect, the invention provides a dispensing container comprising an outer shell comprising a top, a bottom, sidewalls extending between the top and bottom, and two ends, at least one end being open; and an inner tray, slidably received within the outer shell, comprising at least one storage compartment adapted for storage of a plurality of units of a product to be dispensed, and comprising at least one depressible detent, the detent comprising a raised surface that abuts the outer shell. When in a closed configuration, the detent holds the inner tray within the outer shell, and the at least one detent may be depressed by pressure to allow the inner tray to slide relative to the outer shell.

In certain embodiments, the inner tray may slide out from either end of the outer shell. In other embodiments, the outer shell has only one open end and the inner tray is configured to slide outwardly from the open end of the outer shell.

The inner tray can include at least one detent abutting the outer shell at each end of the outer shell. In such an embodiment, the container can be configured such that a detent at each end of the outer shell must be depressed in order to permit the inner tray to slide outwardly from the outer shell.

The dispensing container can contain one or multiple compartments within the inner tray. In one embodiment, the inner tray includes at least two storage compartments separated by a dividing wall therebetween. The inner tray can further include a retainer plate at least partially overhanging the at least one storage compartment. The storage compartments can face either the top or the bottom of the inner tray. For example, the inner tray can comprise at least one storage compartment facing the top of the outer shell and at least one storage compartment facing the bottom of the outer shell.

The dispensing containers of the invention can include a locking mechanism to increase the level of child resistance. For example, the detent of the inner tray can further include a releasable locking component that interlocks with a corresponding locking component of the outer shell. The releasable locking component of the detent can comprise at least one protrusion and the corresponding locking component of the outer shell can comprise at least one aperture configured to receive the at least one protrusion or at least one ridge configured to engage the protrusion in abutting contact such that depressing the detent disengages the protrusion from the aperture or the ridge and permits sliding of the inner tray outwardly from the outer shell. Alternatively, the releasable locking component of the detent comprises at least one aperture or at least one ridge and the corresponding locking component of the outer shell comprises at least one protrusion configured to engage the aperture or the ridge such that depressing the detent disengages the protrusion from the aperture or the ridge and permits sliding of the inner tray outwardly from the outer shell.

The dispensing containers of the invention can include additional features, such as a stop on the inner tray adapted for engaging the outer shell to prevent removal of the inner tray from the outer shell, or a moveable flap in a surface of the storage compartment configured for deflection of a unit of product for dispensing thereof.

The product shape can be characterized, for example, as selected from pill, tablet, sphere, sheet, coin, cube, bead, ovoid, obloid, bean, stick, and rod. The type of product can vary, with examples including pharmaceutical products, smoking products, smokeless tobacco products, snack products, and confectionary products (e.g., candies, mints, and gums).

In another embodiment, the dispensing container of the invention comprises an outer shell comprising a top, a bottom, sidewalls extending between the top and bottom, and two opposing open ends; an inner tray, slidably received within the outer shell and extending from each open end thereof, the inner tray comprising at least one storage compartments adapted for storage of a plurality of units of a product to be dispensed, and comprising at least one depressible detent abutting the outer shell at each end thereof; wherein, in a closed configuration, the depressible detents abutting the outer shell at each end thereof hold the inner tray within the outer shell, and wherein depressing at least one of the detents permits sliding of the inner tray outwardly from the outer shell.

In yet another embodiment, the invention provides a dispensing container comprising an outer shell comprising a top, a bottom, sidewalls extending between the top and bottom, and two opposing open ends; an inner tray, slidably received within the outer shell and extending from each open end thereof, the inner tray comprising at least two storage compartments separated by a dividing wall and adapted for storage of a plurality of units of a product to be dispensed, and comprising a depressible detent abutting the outer shell at each end thereof, each depressible detent comprising a raised surface abutting the top of the outer shell and one or more protrusions proximal to the raised surface and configured to engage at least one ridge in a surface of the top of the outer shell facing the inner tray such that engagement between the detent of the inner tray and the top of the outer shell prevents sliding movement of the inner tray while the inner tray is in a closed and locked position within the outer shell; wherein depressing each depressible detent disengages the inner tray from the outer shell and permits sliding of the inner tray outwardly from the outer shell, the sliding movement of the inner tray resulting in movement of the detent at one end of the inner tray into the outer shell.

In another aspect, the invention provides a method of dispensing a product from a dispensing container. One exemplary method includes the steps of providing a container comprising an outer shell comprising a top, a bottom, sidewalls extending between the top and bottom, and two opposing open ends; an inner tray, slidably received within the outer shell and extending from each open end thereof, the inner tray comprising at least one storage compartments adapted for storage of a plurality of units of a product to be dispensed, and comprising at least one depressible detent abutting the outer shell at each end thereof; depressing at least one of the depressible detents abutting each end of the outer shell; sliding the inner tray outwardly from the outer shell such that the depressed detent slides into the outer shell and the at least one storage compartment is exposed; and removing at least one unit of product from the storage compartment. In one embodiment, the depressing step comprises simultaneously depressing the at least one depressible detent at each end of the outer shell.

It should be appreciated that the present invention can be implemented and utilized in numerous ways, including without limitation as a process, an apparatus, a system, a device, and a method for applications and from other suitable materials now known and later developed. Variations of the illustrative embodiments, including variations in the shape of the sleeve and slide, the number, shape, size and location of any release mechanisms, are also within the contemplation of the present invention and are further described below. These and other unique features of the system disclosed herein will become more readily apparent from the following description and the accompanying drawings.

BRIEF DESCRIPTION OF THE DRAWINGS

Figure 1A:
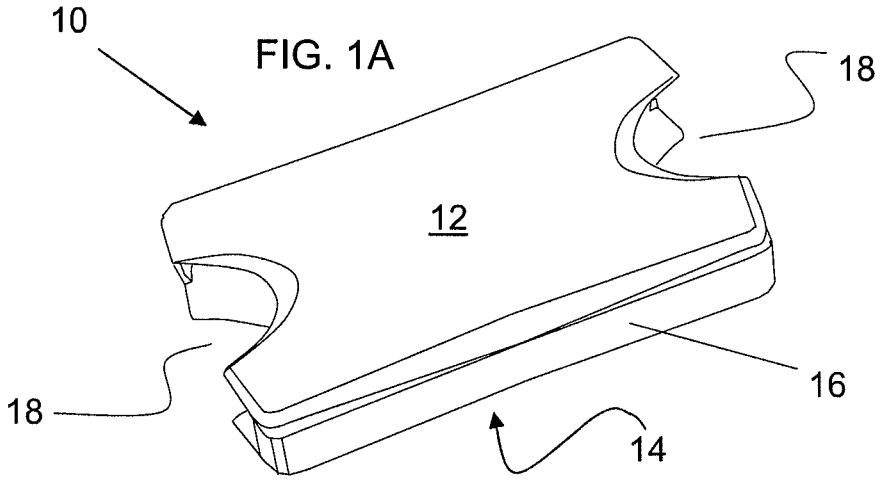
Figure 1B:
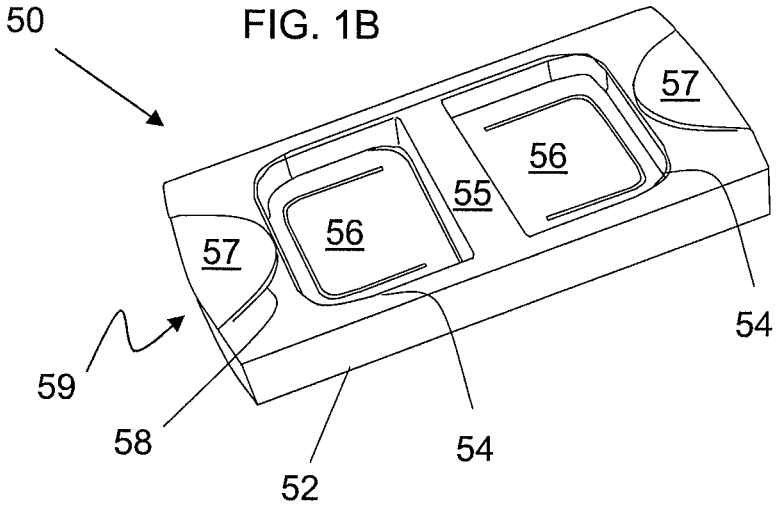
Figure 2A:
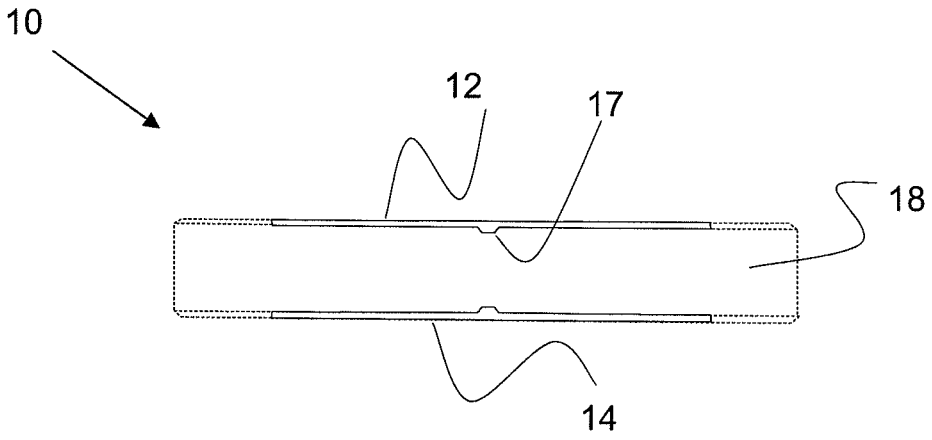
Figure 2B:
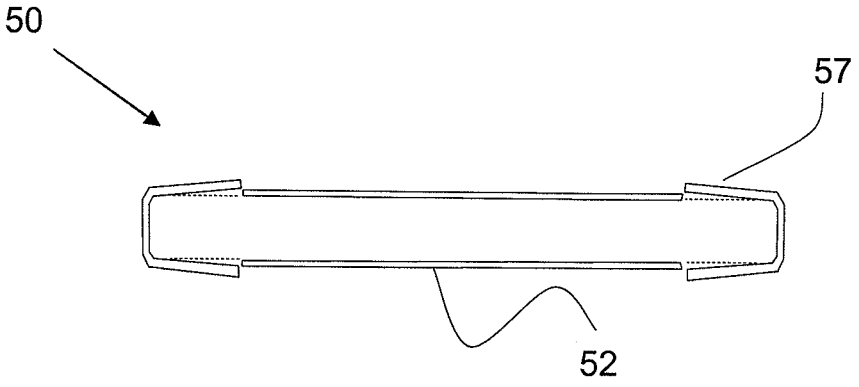
Figure 3A:
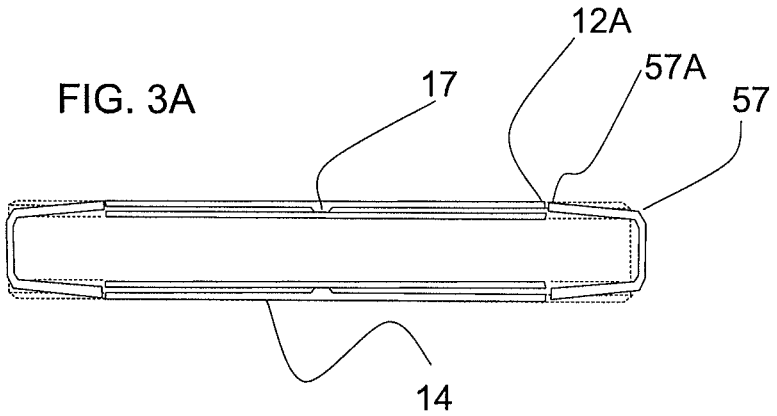
Figure 3B:
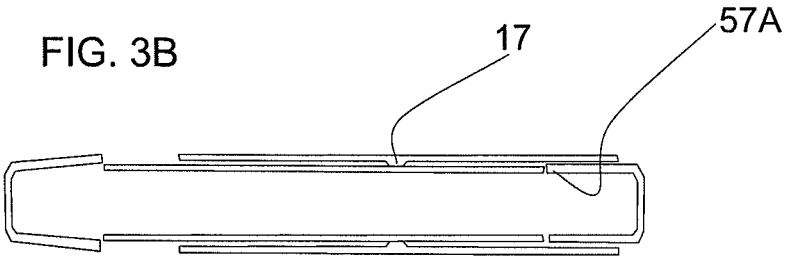
Figure 3C:
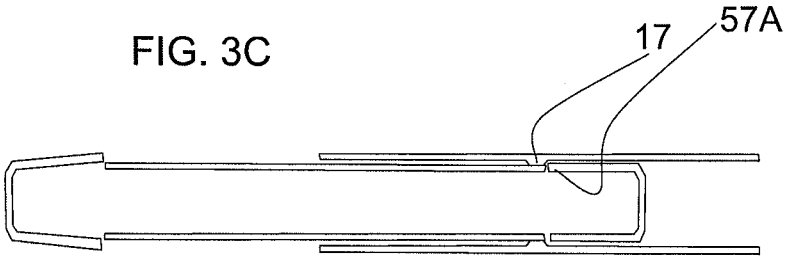
Figure 4A:
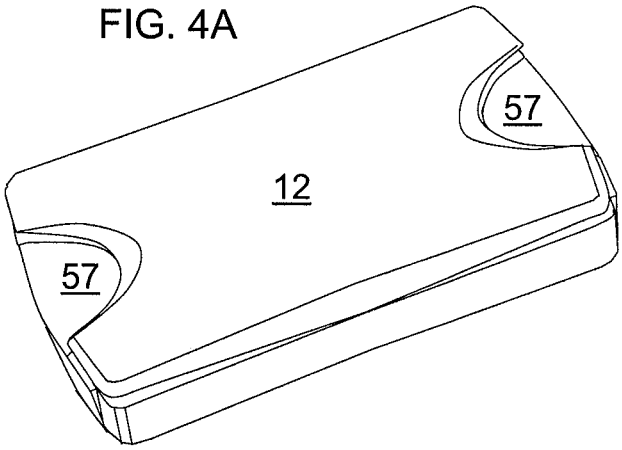
Figure 4B:
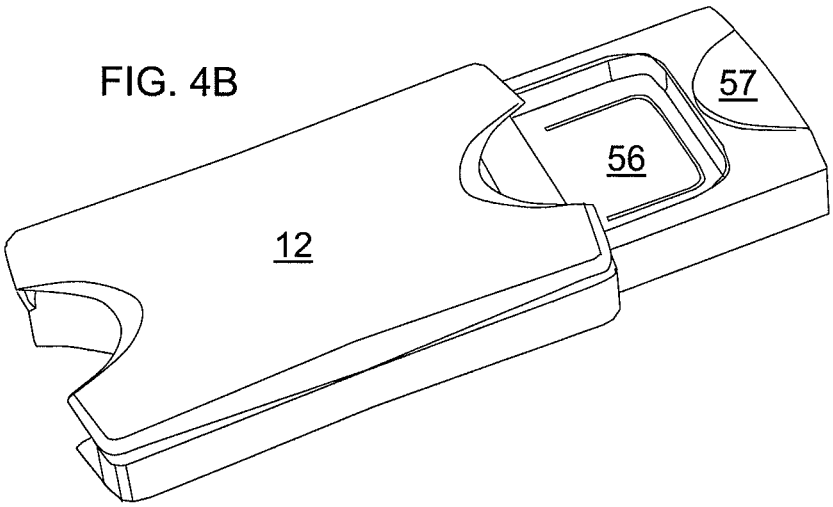
Figure 5:
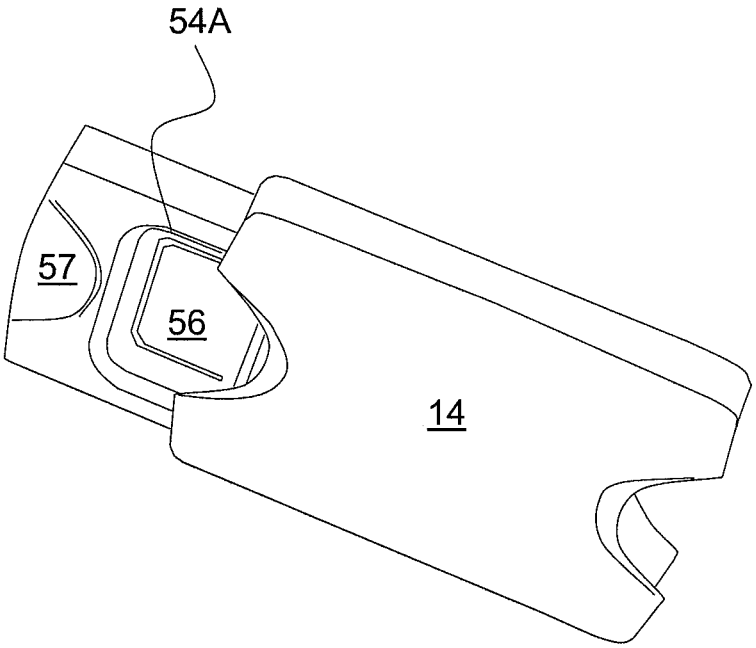
Figure 6A:
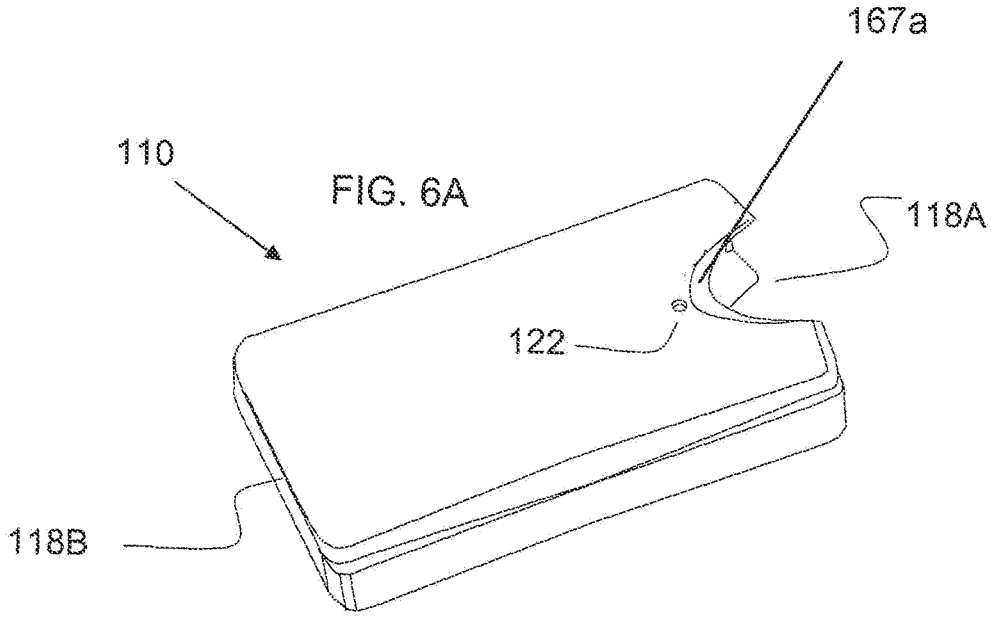
Figure 6B:
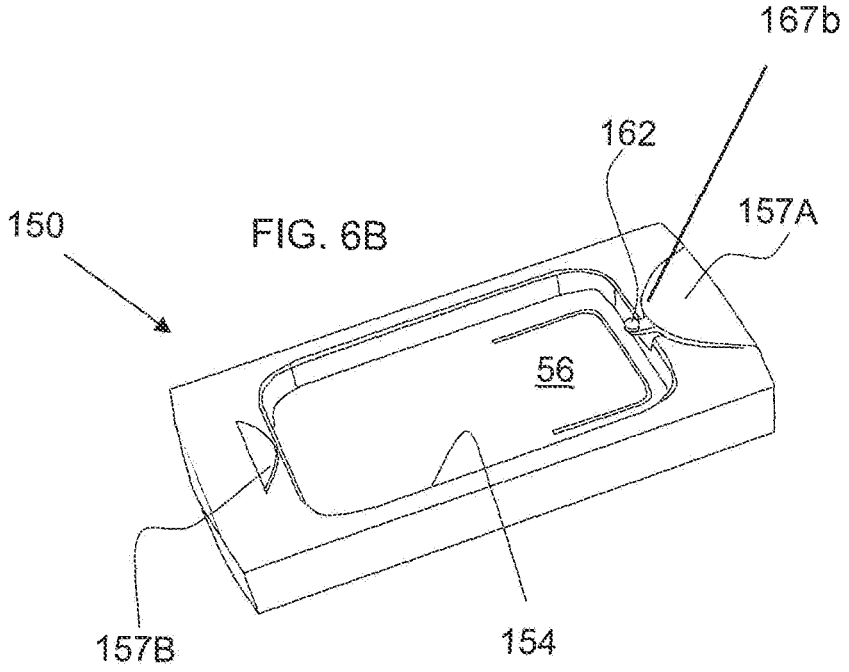
Figure 7A:
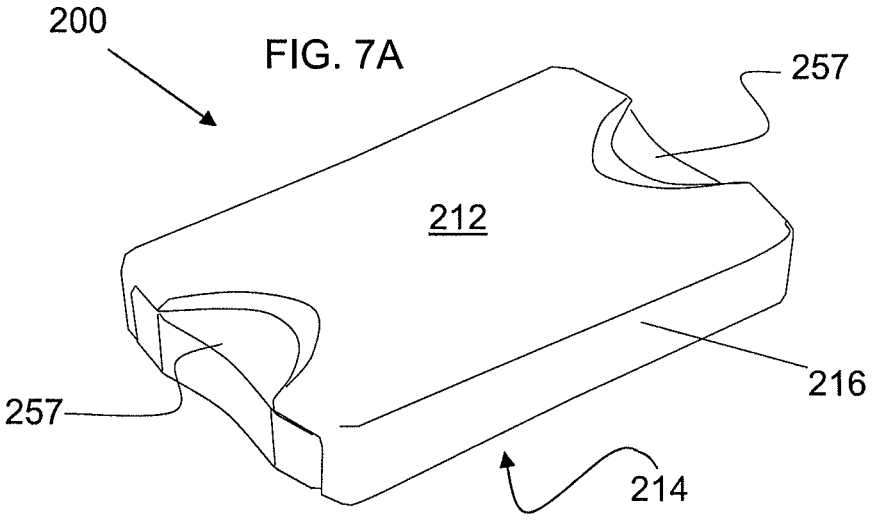
Figure 7B:
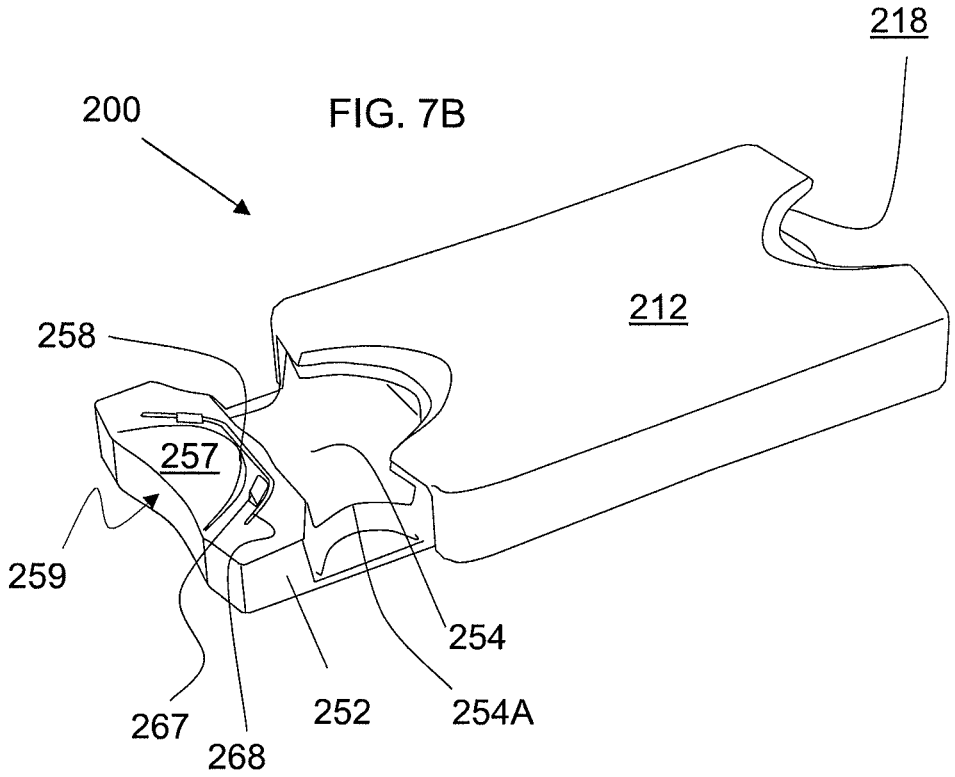
Figure 8:
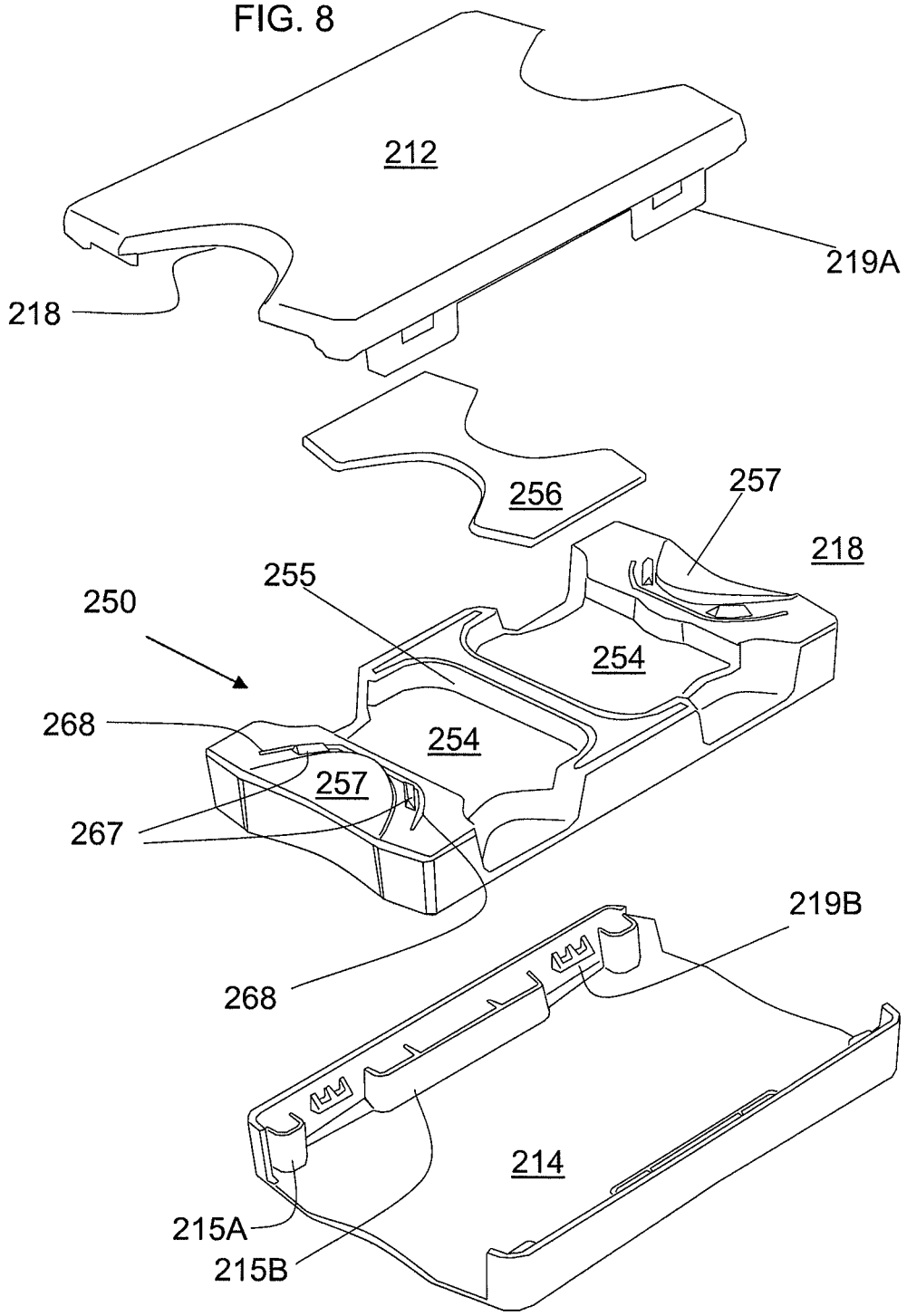
Figure 9:
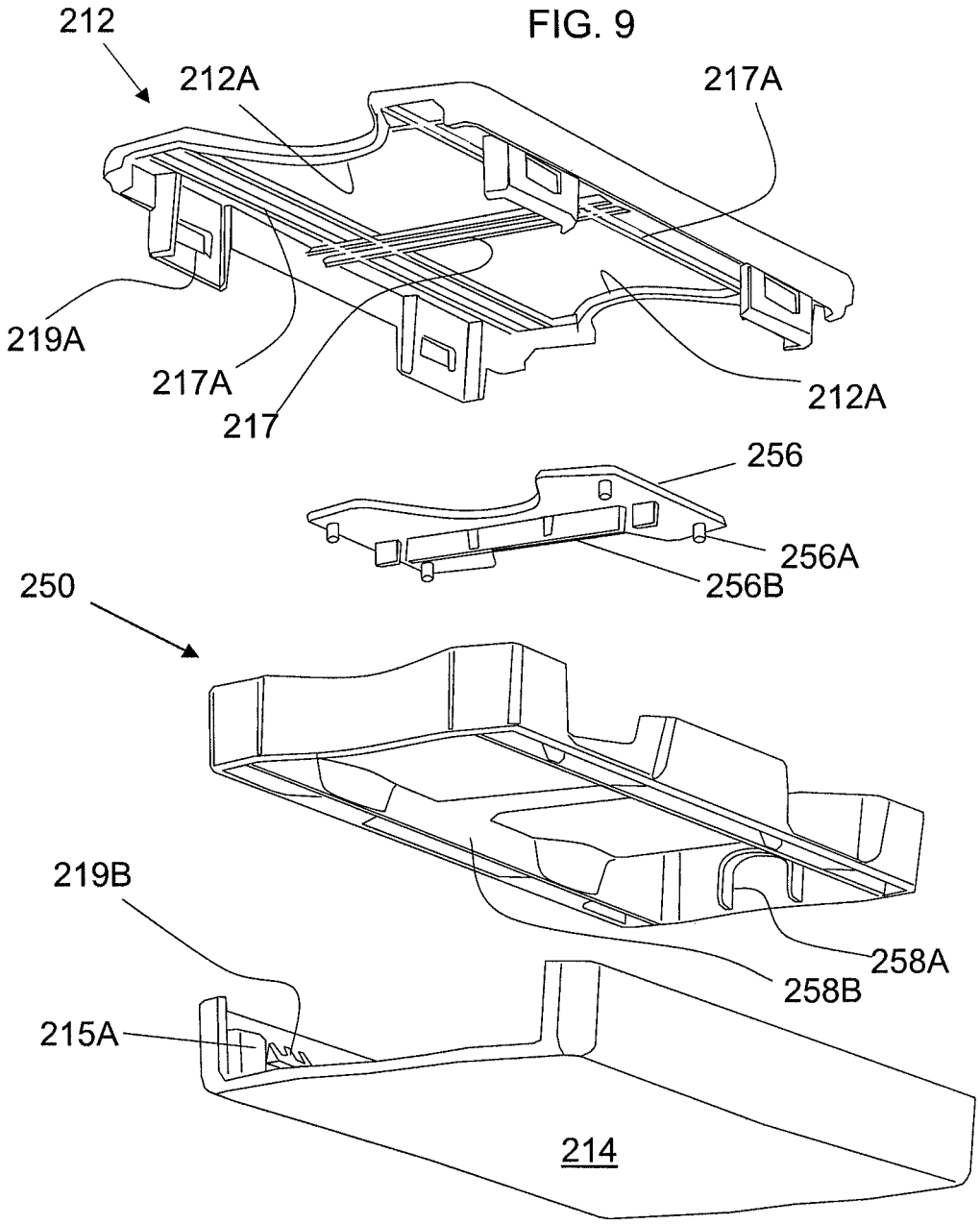

Having thus described the invention in general terms, reference will now be made to the accompanying drawings, which are not necessarily drawn to scale, and wherein:

FIG. 1A is a top perspective view of a shell of a container for holding product items;

FIG. 1B is a top perspective view of a sliding tray of a container for holding product items;

FIG. 2A is a cross section view of the shell of FIG. 1A;

FIG. 2B is a cross section view of the sliding tray of FIG. 1B;

FIG. 3A is a cross section view of the sliding tray enclosed within the shell;

FIG. 3B is a cross section view of the sliding tray partially withdrawn from the shell;

FIG. 3C is a cross section view of the sliding tray more completely withdrawn from the shell;

FIG. 4A is a top perspective view of the sliding tray assembled with the shell, corresponding to FIG. 3A;

FIG. 4B is a top perspective view of the sliding tray withdrawn from the shell, corresponding to FIG. 3C;

FIG. 5 is a bottom perspective view of the sliding tray withdrawn from the shell, corresponding to FIG. 3C;

FIG. 6A is a top perspective view of a single-ended shell;

FIG. 6B is a top perspective view of a sliding tray corresponding to the shell of FIG. 6A;

FIG. 7A is a top perspective view of another container for holding items in a closed configuration;

FIG. 7B is a top perspective view of the container of FIG. 7A in an open configuration;

FIG. 8 is a top perspective, exploded view of the container of FIG. 7A; and FIG. 9 is a bottom perspective, exploded view of the container of FIG. 7A.

DETAILED DESCRIPTION OF EXEMPLARY EMBODIMENTS

The present invention now will be described more fully hereinafter with reference to certain preferred embodiments. These embodiments are provided so that this disclosure will be thorough and complete, and will fully convey the scope of the invention to those skilled in the art. Indeed, the invention may be embodied in many different forms and should not be construed as limited to the embodiments set forth herein; rather, these embodiments are provided so that this disclosure will satisfy applicable legal requirements.

As used in the specification, and in the appended claims, the singular forms "a", "an", "the", include plural referents unless the context clearly dictates otherwise. Certain terms such as "floor," "top," or "bottom," are used herein solely as a means to describe the position of elements of the inventive containers relative to other elements of the containers and not relative to an external point of reference. Consequently, use of such terms does not convey any limitation as to the spatial position of the inventive containers relative to an external point of reference.

The container embodiments described in the present application can be used to store and dispense any solid products, but are particularly well-suited for products designed for oral consumption. Exemplary consumable products include pharmaceutical products such as pills and tablets, cigarettes and other smoking products, diabetes strips, smokeless tobacco products, candies, mints, gums and other confectionary products, snacks, and the like.

Exemplary tobacco products include pelletized tobacco products (e.g., compressed or molded pellets produced from powdered or processed tobacco, such as those formed into the general shape of a coin, cylinder, bean, pellet, sphere, obloid, cube, bead, powder, or the like), extruded or cast pieces of tobacco (e.g., as strips, films or sheets, including multilayered films formed into a desired shape), products incorporating tobacco carried by a solid substrate (e.g., where substrate materials range from edible grains to inedible cellulosic sticks), extruded or formed tobacco-containing rods or sticks, tobacco-containing capsule-like materials having an outer shell region and an inner core region, straw-like (e.g., hollow formed) tobacco-containing shapes, sachets or packets containing tobacco (e.g., snus-like products), pieces of tobacco-containing gum, and the like.

Exemplary smokeless tobacco compositions that can be packaged in the containers of the invention are set forth in, for example, U.S. Pat. Nos. 1,376,586 to Schwartz; 3,368,567 to Speer; 4,513,756 to Pittman et al.; 4,606,357 to Dusek et al; 4,821,749 to Toft et al.; 5,167,244 to Kjerstad; 5,387,416 to White; 6,668,839 to Williams; U.S. 2005/0244521 to Strickland et al.; U.S. 2006/0191548 to Strickland et al.; U.S. 2007/0186942 to Strickland et al.; U.S. 2008/0029110 to Dube et al.; and U.S. 2008/0029116 to Robinson et al. Examples of tobacco-containing gum are set forth in U.S. Pat. Nos. 4,624,269 to Story et al.; 4,975,270 to Kehoe; and 4,802,498 to Ogren.

Various manners or methods for packaging smokeless tobacco products are set forth in U.S. 2004/0217024 and U.S. 2006/0118589 to Arnarp et al.; WO 2005/016036 to Bjorkholm; WO 2006/034450 to Budd; WO 2007/017761 to Kutsch et al.; and WO 2007/067953 to Sheveley et al. All of the above-cited references are incorporated by reference herein in their entirety. Smokeless tobacco compositions utilized as the product contained in the containers of the invention will often include such ingredients as tobacco (typically in particulate form), sweeteners, binders, colorants, pH adjusters, fillers, flavoring agents, disintegration aids, antioxidants, oral care additives, and preservatives. See, for example, U.S. 2007/0186941 to Holton et al., which is incorporated by reference herein in its entirety.

The size and shape of the product to be stored and dispensed can vary. Exemplary product shapes include pills, tablets, spheres, strips, films, sheets, coins, cubes, beads, ovoids, obloids, cylinders, bean-shaped, sticks, or rods. Cross-sectional shape of the products can vary, and exemplary cross-sectional shapes include circles, squares, ovals, rectangles, and the like. The dimensions of the product will often vary depending on its shape.

In one embodiment, the product is in the form of a flattened sheet or film. The sheet-like or film material typically has a shape that can be described as generally rectangular (optionally with rounded corners or edges), oval, triangular, or diamond-shaped. A generally rectangular sheet or film product will typically have a length in the range of about 20 to about 40 mm, more often about 25 to about 35 mm, and in some cases, between about 30 and about 35 mm (e.g., about 33 mm). The width of a generally rectangular sheet or film product will typically range from about 12 to about 28 mm, more often about 15 to about 25 mm, and in some cases, between about 18 and about 22 mm (e.g., about 20 mm). The thickness of the sheet or film product is typically within the range of about 0.05 to about 0.75 mm, more often about 0.1 to about 0.5 mm, and in some cases, between about 0.15 and about 0.25 mm. Sheet-shaped products are typically arranged in a stacked configuration within the storage compartment of the containers of the invention.

When the product is a smokeless tobacco composition, the sheet or film product can take a variety of forms, including films or sheets formed using tobacco reconstitution techniques known in the art. Alternatively, the sheet or film product can be in the form of so-called "edible films" or "orally dissolvable strips" that incorporate a tobacco component Exemplary sheet or film materials are set forth in U.S. Pat. Nos. 5,587,172 to Cherukuri et al.; 5,733,577 to Myers et al.; 5,869,098 to Misra et al.; 5,871,781 to Myers et al.; 6,337,082 to Fuisz et al.; 6,596,298 to Leung et al.; 7,067,115 to Bess et al.; and 7,025,983 to Leung et al.; U.S. 2004/0241242 to Fuisz et al.; U.S. 2005/0244521 to Strickland et al.; U.S. 2006/0039953 to Leung et al.; U.S. 2006/0198873 to Chan et al.; U.S. 2006/0204559 to Bess et al.; U.S. 2007/0069416 to Yang et al.; U.S. 2008/0029110 to Dube et al.; USSN 11/781,641 to Mua et al. (2007); and USSN 12/014,525 to Robinson et al. (2008), all of which are incorporated by reference herein in their entirety.

The shape of the outer surface of the containers of the invention can vary. Although the container embodiments illustrated in the drawings have certain contours, containers with other exterior surface designs could also be used. For example, the sides or edges of the containers of the invention could be flattened, rounded, or beveled, and the various surfaces or edges of the container exterior could be concave or convex. Further, the opposing sides, ends, or edges of the container can be parallel or non-parallel such that the container becomes narrower in one or more dimensions.

The dimensions of the containers described herein can vary without departing from the invention. However, in preferred embodiments, the containers of the invention can be described as having a size suitable for handheld manipulation and operation. Exemplary dimensions for such handheld embodiments include lengths in the range of about 25 mm to about 200 mm, more typically about 50 mm to about 150 mm, and most often about 80 mm to about 120 mm. Exemplary widths include the range of about 10 mm to about 100 mm, more typically about 20 mm to about 80 mm, and most often about 30 mm to about 60 mm. As used herein, length and width refer to the major dimensions of the container that define the major plane of the container. Exemplary depths for handheld container embodiments of the invention range from about 5 mm to about 50 mm, more typically about 8 mm to about 30 mm, and most often about 10 mm to about 20 mm.

The number of solid product units stored in the containers of the invention can also vary, depending on the size of the container and the size of the product units. Typically, the number of stored product units will vary from about 5 to about 100, more typically about 10 to about 50, and most often about 10 to about 30 (e.g., about 10, about 15, about 20, or about 25).

The material of construction of the container can also vary. Exemplary materials include metal, wood, and synthetic plastic materials. Polymeric materials that can be extruded and/or molded into desired shapes are typically utilized, such as polyethylene, polystyrene, polyamide, and the like.

In certain embodiments, the containers of the invention provide advantageous features such as child-resistance. In particular, certain embodiments of the containers of the invention include a child-resistant locking mechanism that releasably locks the inner tray of the container in a closed and locked position. The locking mechanism can be released and a product dispensed using a series of manipulations including, for example, depressing one or more detents of the inner tray and sliding the inner tray to expose the product to be dispensed.

FIG. 1A is a top perspective view of an outer shell 10 of a container for holding product items. Shell 10, for example, may be a generally rectangular tube, with shell top 12, shell bottom 14, and sidewalls 16. The ends of the shell 10 may be open, and provided with cutout areas 18, which in FIG. 1A are shown with an exemplary shape of a cutaway arc.

The cutout area may be formed in a variety of shapes such as rectangular, triangular, or circular as determined by manufacturing preferences.

FIG. 1B is a top perspective view of a sliding inner tray 50 of a container for holding product items. Sliding tray 50 may fit inside shell 10. Sliding tray 50 may comprise a generally rectangular tray body 52, partly enclosing one or more storage compartments 54 for holding product items, for example in a strip form, pellet form, powder form, or other form. If there are multiple storage compartments 54, the compartments may be separated by divider wall 55. The bottom of the compartment 54 may comprise a flexible flap portion 56 whose purpose will be described later. Flexible flap portion 56 may be bounded by a cutaway line through the bottom of the compartment 54. The ends of sliding tray 50 may comprise detents 57 that include a raised surface that engages the cutout areas 18 of shell 10. As shown, the sliding tray can include at least two detents 57, one positioned at each end of the tray. The detents 57 may flex inward with respect to the tray body 52. To facilitate a flexing action, detents 57 may be partially bounded by a cut line 58. Instead of or in addition to cut line 58, an end 59 of sliding tray 50 may be left open to allow detents 57 to flex inward.

FIG. 2A is a side cross section view of shell 10. Inside the shell, for example on the inside of shell top 12, or shell bottom 14, or both, may be a protrusion 17 that may act to stop sliding tray 50 at a particular location within shell 10, for example, to prevent sliding tray 50 from being completely removed from shell 10.

FIG. 2B is a cross section side view of sliding tray 50. The central portion or sliding tray body 52 is denoted, as is detent 57 that may protrude slightly outward from tray body 52, but which may be flexed inward relative to the tray body.

FIG. 3A is a cross section side view of the sliding tray enclosed within the shell, for example, in a closed position. A detent edge 57A of detent 57 in its normal state (outward relative to the tray body) may engage or abut an edge 12A of the shell, and may hold the tray within the shell. To release the tray and allow sliding movement, the depressible detents 57 may be pinched so that their detent edges 57A may flex inward with respect to the tray body, and may clear the abutting edge 12A. As shown in FIG. 3B, the pinched detents 57 may cause detent edges 57A to flex inward and may allow the sliding tray to be pushed into the shell, causing the opposite end of the tray to be pushed out of the shell. Access may thus be provided to the contents of the tray.

FIG. 3C is a cross section view of the sliding tray more completely withdrawn from the shell. The detent edges 57A may now engage protrusion 17 and cause the tray to cease sliding outward from the shell. When the user wishes to close the container, the sliding tray may be pushed back inside the shell until detent edges 57A once again may engage abutting edge 12A and prevent the tray from further movement in either direction.

FIG. 4A is a top perspective view of the sliding tray assembled with the shell, corresponding to the cross sectional view of FIG. 3A. The edges of detents 57 may engage the adjoining edges of the shell, and thus hold the sliding tray within the shell. If the detents 57 at one end of the tray are pinched together, that end of the sliding tray may be pushed into the shell as shown in FIG. 4B, which in turn causes the opposite end of the sliding tray to protrude from the shell, corresponding to FIG. 3C, and allowing access to the contents of the sliding tray, for example in storage compartment 54. The depth of compartment 54 may be chosen to correspond to a particular number of content items. Although no content items are shown in the drawing, it is understood that contents may include items in the form of strips, sheets, sticks, pellets, lozenges, and any other form. For certain items such as strips or sheets, the user may push upward from under the tray, lifting flexible flap portion 56 and thus slightly elevating the items to make them more accessible.

FIG. 5 is a bottom perspective view of the sliding tray withdrawn from the shell, corresponding to FIG. 3C, and showing an alternate view of the flexible flap portion 56. The tray may comprise an underside recess or underside compartment 54A. Such a recess might be used to reduce the volume of storage compartment 54. Alternately, underside compartment 54A might contain a useful item such as an advertisement, instructions, or additional contents. If such contents were placed in underside compartment 54A, the shell or tray could include features to help retain the contents against falling from the tray, such as a clipping member (not shown) biased against the floor of the compartment 54A that would act to prevent stored material from dropping out of the underside compartment upon opening the container.

While the exemplary embodiment shown so far comprises a double-ended container, that is, a container wherein the sliding tray 50 may be extended from either end of shell 10, it is also possible to form a single-ended container, as shown in FIGS. 6A and 6B. FIG. 6A is a top perspective view of a single-ended shell 110. While similar in some respects to shell 10, single-ended shell 110 may have one open end 118A and one closed end 118B. The closed end of shell 110 may either have no opening, or have an opening whose size does not permit passage of sliding tray 150. Alternately, shell 110 and/or sliding tray 150 may be provided with interacting features that may prevent passage of the tray through the "closed" end of the shell.

Single-ended shell 110 may be provided with a lock aperture or recess 122. Correspondingly, single-ended sliding tray 150 may have a lock pin or protrusion 162, for example attached to detent 157A. Thus, when detent 157A is pinched or depressed, lock pin 162 may be moved clear from lock aperture 122, permitting single-ended sliding tray 150 to be withdrawn from shell 110. A stop detent 157B may be provided elsewhere on sliding tray 150 to limit its movement from shell 110 so that the inner tray cannot be completely removed from the shell. For example, such a stop detent may engage protrusion 17 shown on FIG. 3C. The protrusion may be located at any point, including locations other than the longitudinal midpoint of the shell. Compartment 154 may be larger than for a double-ended container. Flexible flap portion 56 may have a different location or size than for a double-ended container.

The disclosed features of the shell and sliding tray may be used in combinations to provide a variety of containers. There may be multiple detents 57, for example, four detents as shown in FIGS. 1-5. In the illustrated embodiment of FIGS. 1-5, the inner tray includes two opposing detents at each end, each of the opposing detents abutting the edge of the outer shell, with one abutting the edge of the top of the shell and one abutting the edge of the bottom of the shell. There may be as few as one detent 57. If a detent is used at each end of the container, the detents may be on both top and bottom, or only on the top, or only on the bottom. A detent may be provided on the top at one end and on the bottom at the other end. There may be one or more compartments 54 and 154, with varying depths as desired. The compartments may both be on the top, or on alternate sides. The size, shape, and location of various features, such as flexible flap portion 56 or detent 57 (and the corresponding cutout area 18) may be modified. However, it is noted that the U-shaped flexible flap portion and detent portion may be sized and shaped to fit the fingers and assist in improving the functionality of the package. One or more divider walls 55 may be employed. If it is desired to have a double-ended container that allows the sliding tray 50 to be withdrawn more than halfway from shell 10, then one or more stop protrusions 17 may be provided offset from the centerline of the shell, and engaging one or more tray features (not shown) that may also be offset. Thus, it may be possible to move sliding tray two-thirds of the way out of shell 10.

FIG. 7A shows another container 200 in a closed configuration. Container 200 may comprise a shell with a shell top 212 and shell bottom 214 and shell sidewalls 216. The shell may contain a sliding tray which includes detents 257 at each end, which may fit into shell cutout areas 218 and which include a raised surface that abuts the edge of the outer shell. Container 200 may be adapted so that both detents may be pressed in order to allow sliding motion of the tray.

FIG. 7B shows container 200 in an open configuration. To open the container, both detents 257 may be depressed by the user. Pressing detent 257 lowers the detent (clearing the shell top edge 212A) so that tray 250 may slide into the shell, and also lowers protrusions or pins 267 (clearing the shell top edge or raised ridge 212A shown in FIG. 9) so that tray 250 may slide outwardly from one end of the shell. The tray may comprise tray body 252 and one or more compartments 254. Compartment 254 may comprise features such as undercut 254A to allow easier access to the contents of the compartment. The undercut 254A, together with the absence of sidewalls on the compartment, allows the product to extend beyond the edge of the floor of the compartment such that the product can be grasped more easily by the user. Detent 257 may be situated near each end of the tray, proximate to tray end wall 259. To facilitate flexing of detent 257, a slot or cutout 268 may be provided, for example as an approximately "U"-shaped opening proximate to the detent. Thus when detent 257 is pressed inward, it may flex more readily, allowing it to drop downward along with the protrusions 267. Thus both detent 257 and protrusions 267 may clear the edge 212A and allow the tray to move outward or inward with respect to the shell.

FIGS. 8 and 9 show an exploded view of the container 200 as seen from the top and bottom, respectively. Shell top latches 219A may be provided to mate with shell bottom latches 219B, thus securing the shell together. Note, however, that other means of attaching the two shell components can be utilized. In addition, the shell body can be formed as a unitary structure. Shell top 212 may have cutout areas 218 that form a complimentary fit for tray detents 257 such that the detents meet the edge of the cutout areas in abutting contact when the tray is in the closed and locked position.

Tray 250 may be provided at each end with detent 257, and with protrusions 267 that flex downward with detents 257 when the detents are depressed. To facilitate this flexing, slot 268 may be provided. Detent 257 may, in the closed configuration, abut the outside of edge 212A, preventing a detent 257 from moving into the shell (unless the detent is pressed). Protrusions 267, in the closed configuration, may abut the inside of edge 212A, preventing the protrusions from moving out of the shell (unless the detent is pressed). Note that although the illustrated embodiment includes two protrusions 267, the number of protrusions may vary and certain embodiments may have only one protrusion or more than two protrusions.

Certain features may be provided inside the shell top 212 or shell bottom 214, for example to strengthen the shell, or provide for a smoother sliding motion and more precise fit of parts. Side rails 215A and 215B, shown formed inside the sides of shell bottom 214, may provide lateral support or guidance for sliding tray 250. One or more transverse ridge 217 may be provided to form a stopping point on which the edge of detent 257 may catch when sliding tray 250 has moved about halfway out of the shell. Thus, the sliding tray 250 may be retained from being completely removed from the shell. One or more lateral ridge 217A may be provided on which the top of tray 250 may bear, which may help govern the clearance between detent 257 and protrusion 267 on one hand, and shell edge 212A and lateral ridge 217A on the other hand. The tray 250 may be provided with certain additional features, for example to increase strength or improve fit with the shell. For example, end buttresses 258A may be formed to increase the strength of the tray end, which may be subjected to a flexing force when detent 257 is pressed. As shown, end buttresses 258A can extend in the shape of an arc with the top of the arc positioned underneath the detents 257. Other buttress configurations could also be used, such as one or more ribs extending from proximal to the bottom edge of the tray to the underside of the detent 257. Side ribs 258B may be provided for strength.

A compartment retainer 256 may be provided which partially overhangs compartment 254, and may help retain the items therein. The compartment retainer 256 may, for example, have a "dog-bone" shape as shown, although many other shapes may be used. The retainer may attach to divider wall 255, for example by use of attachment pins 256A or attachment ribs 256B. The divider shape could be a company logo or symbol. The bone shape depicted may maximize the space available in the dual containers. The divider wall 255 could also be integrally formed with the inner tray.

Container 200 may require that both detents 257 be depressed in order to open the container. For example if both detents are depressed, the sliding tray 250 may be moved to the right, since the left detent 257 drops downward and can pass under and to the inside of left shell edge or ridge 212A. Meanwhile, the right protrusions 258 drop downward and may pass under and to the outside of right shell edge or ridge 212A. Movement of sliding tray 250 to the left is likewise enabled if both detents are depressed. However, if either detent is not depressed, this sliding motion is inhibited in both directions. In this manner, the level of child resistance can be enhanced by requiring digital manipulation of both detents simultaneously in order to open the container and expose the product.

While container 200 as illustrated may allow tray 250 to slide out of the container in either direction, it should be understood that the container may be designed so that the tray only slides out of one end. For example, the other end of the container may be partially closed, to prevent the tray from sliding outward, or an internal stop (not shown) may be provided to prevent the tray from sliding out of one end. Even if the tray may slide out of only one end, the detent action as described may still be utilized in order that both detents may be depressed in order to allow sliding motion.

While the exemplary containers shown here are relatively thin and have a length-to-width ratio of approximately two, the dimensions may be modified to suit the intended use. For example, besides engaging the abutting edge 12A and ridge 212A and protrusion 17, 217, the detent edge 57A, 257 of sliding tray 50, 250 may bear upon other features of the shell, for example, dimples, ridges, or other features (some not shown).

As an example, shell 10, 210 and sliding tray 50, 250 may be used as a container to provide a child resistant package that would hold ten strip-shaped items in each of compartments 54, 254. Access may be provided to only one compartment at a time. In its locked position, the tray compartments may not be accessible to the user and may be hidden from view by the shell.

The shell and sliding tray could each be made of a single part or multiple parts. Various surfaces of both the shell and sliding tray may be used as a surface for printing or printed material. Although the illustrated embodiments of the container locking mechanisms set forth herein include locking apertures or ridges on the outer shell (see, e.g., a first locking component 167*a* in FIG. 6A) and corresponding pins or protrusions on the sliding tray (see, e.g., a second locking component 167*b* in FIG. 6B), the location of each type of locking mechanism could be switched without departing from the invention. Specifically, the locking aperture or ridge could be located on the sliding tray, for example proximal to the detent, and the corresponding pins or protrusions adapted to engage the aperture or ridge can be located on the outer shell.

As part of the final packaging process, once the dispensing containers of the invention are filled with the desired product, the containers can be over-wrapped or over-sealed with a film material, or shrink-wrapped with such a material. The outer packaging material useful in accordance with the present invention can vary. Typically, the selection of the packaging material is dependent upon factors such as aesthetics, transparency, comfort of handling, desired barrier properties (e.g., so as to provide protection from exposure to oxygen or radiation, or so as to provide protection from loss of moisture), or the like. The packaging material preferably has the form of a film, such as a laminated film (e.g., a co-extruded laminated film). Representative materials that can be used to provide components or layers of film materials or laminated films include polyvinyl chloride, ethylene vinyl acetate co-polymer, oriented polypropylene, linear low density polyethylene, polyvinylidene dichloride, polyester terephthalate, ethylene methacrylic acid co-polymer, metallacene linear low density polyethylene, cellulosic materials (e.g., cellophane), and the like. Exemplary packaging materials can be plastic/metal films, plastic/metal films that are paper coated, plastic laminate films, or the like. U.S. 2008/0029116 to Robinson et al. discloses examples of suitable packaging materials.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method of dispensing a product from a container, comprising:

providing a container comprising an outer shell comprising a top, a bottom, sidewalls extending between the top and bottom, and two opposing open ends; an inner tray slidably received within the outer shell and extendable from each of the two opposing open ends, the inner tray comprising at least one storage compartments adapted for storage of a plurality of units of the product to be dispensed and at least one depressible detent disposed at each end of the inner tray, each depressible detent comprising a raised surface that abuts an outer perimeter of each of the opposing open ends of the outer shell in a closed configuration;

depressing the at least one depressible detent abutting the outer perimeter of one of the two opposing open ends of the outer shell;

sliding the inner tray outwardly from the outer shell such that the depressed detent slides into the outer shell and the at least one storage compartment is exposed; and removing at least one unit of the product form the storage compartment.

2. The method of claim 1, wherein said depressing step comprises simultaneously depressing the at least one depressible detent at each open end of the outer shell.

3. The method of claim 2, wherein the at least one depressible detent further comprises a releasable locking component that interlocks with a corresponding locking component of the outer shell, and said step of depressing the at least one depressible detent at each end of the outer shell results in disengagement of the locking components such that the inner tray is permitted to slide within the outer tray.

* * * * *